US011739958B2

(12) United States Patent
Klopfenstein et al.

(10) Patent No.: US 11,739,958 B2
(45) Date of Patent: Aug. 29, 2023

(54) UNDER-FLOOR PLIABLE AIR DUCT/DISPERSION SYSTEMS

(71) Applicant: Rite-Hite Holding Corporation, Milwaukee, WI (US)

(72) Inventors: Jeffrey Klopfenstein, Dubuque, IA (US); Kevin J. Gebke, Dubuque, IA (US); Nicolas B. Paschke, Mequon, WI (US)

(73) Assignee: RITE-HITE HOLDING CORPORATION, Milwaukee, WI (US)

( * ) Notice: Subject to any disclaimer, the term of this patent is extended or adjusted under 35 U.S.C. 154(b) by 0 days.

(21) Appl. No.: 17/583,186

(22) Filed: Jan. 24, 2022

(65) Prior Publication Data

US 2022/0146139 A1 May 12, 2022

Related U.S. Application Data

(63) Continuation of application No. 16/397,692, filed on Apr. 29, 2019, now Pat. No. 11,231,189, which is a (Continued)

(51) Int. Cl.

| | |
|---|---|
| ***F24F 7/10*** | (2006.01) |
| ***F24F 13/02*** | (2006.01) |
| ***F24F 13/06*** | (2006.01) |

(52) U.S. Cl.

CPC ..... *F24F 7/10* (2013.01); *F24F 13/0218* (2013.01); *F24F 13/0227* (2013.01); (Continued)

(58) Field of Classification Search

CPC ..... F24F 7/10; F24F 13/0218; F24F 13/0227; F24F 13/0254; F24F 2013/0608; Y10T 29/53

See application file for complete search history.

(56) References Cited

U.S. PATENT DOCUMENTS 1,597,588 A 8/1926 Fairbanks
2,133,783 A 10/1938 Merrill
(Continued)

OTHER PUBLICATIONS

United States Patent and Trademark Office, "Non Final Office Action" issued in connection with U.S. Appl. No. 16/397,692, dated Apr. 1, 2021, 14 pages.

(Continued)

*Primary Examiner* — Jessica Yuen

(74) *Attorney, Agent, or Firm* — Hanley, Flight & Zimmerman, LLC

(57) ABSTRACT

An under-floor HVAC system for a building includes a pliable air duct lying upon a subfloor. A matrix of pedestals resting upon and extending upward from the subfloor supports a set of floor panels, which thus creates a plenum between the subfloor and the set of floor panels. The air duct extends through the plenum to convey conditioned air from a supply air duct to a series of registers in the floor panels. The registers disperse the conditioned air to a room or area just above the panels. To help keep the air duct from repeatedly extending, retracting, and otherwise sliding freely along the subfloor in response to changes in air duct pressure, the air duct is held taut by anchoring a distal downstream end of the duct to one or more of the floor-supporting pedestals. Various air duct configurations can be assembled from a predefined assortment of duct components.

15 Claims, 3 Drawing Sheets

Related U.S. Application Data continuation of application No. 12/196,999, filed on Aug. 22, 2008, now Pat. No. 10,274,216.

(52) U.S. Cl.
CPC .. *F24F 13/0254* (2013.01); *F24F 2013/0608* (2013.01); *Y10T 29/53* (2015.01)

(56) References Cited

U.S. PATENT DOCUMENTS

| | | | |
|---|---|---|---|
| 3,316,680 | A | 5/1967 | Chrastek |
| 3,595,299 | A | 7/1971 | Weishaupt |
| 3,639,054 | A | 2/1972 | Wally, Jr. |
| 4,030,518 | A | 6/1977 | Wilcox |
| 4,117,697 | A | 10/1978 | Myers et al. |
| 4,161,193 | A | 7/1979 | Freychet et al. |
| 4,425,839 | A | 1/1984 | Stull |
| 4,578,910 | A | 4/1986 | Germeroth et al. |
| 4,671,811 | A | 6/1987 | Cadwell, Jr. et al. |
| 4,773,197 | A | 9/1988 | Sullivan |
| 4,781,515 | A | 11/1988 | Johnson |
| 4,829,882 | A | 5/1989 | Jackson |
| 5,234,374 | A | 8/1993 | Hyzyk et al. |
| 5,240,288 | A | 8/1993 | Inda et al. |
| 5,294,049 | A | 3/1994 | Trunkle et al. |
| 5,316,035 | A | 5/1994 | Collins et al. |
| 5,468,184 | A | 11/1995 | Collier |
| 5,477,649 | A | 12/1995 | Bessert |
| 5,542,223 | A | 8/1996 | Inda et al. |
| 5,655,963 | A | 8/1997 | Paschke et al. |
| 6,280,320 | B1 | 8/2001 | Paschke et al. |
| 6,425,417 | B1 | 7/2002 | Paschke |
| 6,468,054 | B1 | 10/2002 | Anthony et al. |
| 6,524,182 | B2 | 2/2003 | Kilburn et al. |
| 6,558,250 | B1 | 5/2003 | Paschke |
| 7,169,039 | B2 | 1/2007 | Oppedisano et al. |
| 7,238,106 | B2 | 7/2007 | Scott |
| 9,322,561 | B2 | 4/2016 | Ikeda et al. |
| 9,451,730 | B2 | 9/2016 | Gardner |
| 9,758,982 | B2 | 9/2017 | Anderson, Jr. et al. |
| 9,894,809 | B1 | 2/2018 | Springs et al. |
| 10,274,216 | B2 | 4/2019 | Klopfenstein et al. |
| 11,231,189 | B2 | 1/2022 | Klopfenstein et al. |
| 2004/0181921 | A1 | 9/2004 | Alles |
| 2007/0074525 | A1 | 4/2007 | Vinson et al. |
| 2010/0048121 | A1 | 2/2010 | Klopfenstein et al. |

OTHER PUBLICATIONS

United States Patent and Trademark Office, "Notice of Allowance and Fee(s) Due" issued in connection with U.S. Appl. No. 16/397,692, dated Sep. 20, 2021 5 pages.

United States Patent and Trademark Office, "Notice of Allowance and Fees Due" issued in connection with U.S. Appl. No. 12/196,999, dated Jan. 8, 2019, 8 pages.

United States Patent and Trademark Office, "Non-Final Office Action" issued in connection with U.S. Appl. No. 12/196,999, dated Mar. 22, 2018, 23 pages.

United States Patent and Trademark Office, "Non-Final Office Action" issued in connection with U.S. Appl. No. 12/196,999, dated Jun. 30, 2017, 25 pages.

United States Patent and Trademark Office, "Final Office Action" issued in connection with U.S. Appl. No. 12/196,999, dated Feb. 25, 2016, 20 pages.

United States Patent and Trademark Office, "Non-Final Office Action" issued in connection with U.S. Appl. No. 12/196,999, dated Aug. 18, 2011, 18 pages.

United States Patent and Trademark Office, "Non-Final Office Action" issued in connection with U.S. Appl. No. 12/196,999, dated Jul. 31, 2015, 17 pages.

United States Patent and Trademark Office, "Final Office Action" issued in connection with U.S. Appl. No. 12/196,999, dated Jan. 16, 2015, 16 pages.

United States Patent and Trademark Office, "Non-Final Office Action" issued in connection with U.S. Appl. No. 12/196,999, dated Jun. 20, 2014, 14 pages.

United States Patent and Trademark Office, "Final Office Action" issued in connection with U.S. Appl. No. 12/196,999, dated Mar. 16, 2012, 14 pages.

United States Patent and Trademark Office, "Advisory Action" issued in connection with U.S. Appl. No. 12/196,999, dated Jul. 15, 2016, 3 pages.

United States Patent and Trademark Office, "Advisory Action" issued in connection with U.S. Appl. No. 12/196,999, dated Apr. 9, 2015, 3 pages.

UNDER-FLOOR PLIABLE AIR DUCT/DISPERSION SYSTEMS

RELATED APPLICATIONS

This patent arises from a continuation of U.S. patent application Ser. No. 16/397,692 (now U.S. Pat. No. 11,231,189), which was filed on Apr. 29, 2019, and which is a continuation of U.S. patent application Ser. No. 12/196,999 (now U.S. Pat. No. 10,274,216), which was filed on Aug. 22, 2008. U.S. patent application Ser. No. 16/397,692 and U.S. patent application Ser. No. 12/196,999 are hereby incorporated herein by reference in their entireties. Priority to U.S. patent application Ser. No. 16/397,692 and U.S. patent application Ser. No. 12/196,999 is claimed

FIELD OF THE DISCLOSURE

This patent generally pertains to HVAC systems (heating, ventilating and air conditioning systems) and, more specifically, to under-floor air ducts.

BACKGROUND

To heat, cool, filter, dehumidify, ventilate or otherwise condition the indoor air of a comfort zone, such as a room or area in a building, the floor of some buildings have a supply air plenum between a subfloor and a matrix of floor panels that are elevated about one or two feet just above the subfloor. The floor panels, which are usually supported by a matrix of pedestals extending upward from the subfloor, provide the surface upon which the building occupants walk and furniture is set.

With an under-floor HVAC system, a supply air duct discharges fresh or conditioned supply air into the plenum, which in turn conveys the supply air to a series of supply air registers or openings in the floor panels. The registers release the supply air from within the plenum up into the comfort zone. The general goal is to have a sufficient number of properly placed registers such that the supply air rises evenly up through the comfort zone for the benefit of the occupants at floor level. As the supply air continues to rise above the occupants, the eventually used or less-than-fresh air approaches the ceiling to where one or more return air ducts extracts the air for reconditioning and/or exhausting outdoors.

One problem, however, is that if the air from the supply air duct has to travel a great distance to a remote register, the supply air might lose much of its desirable temperature by heat transfer with the subfloor, particularly if the subfloor is made of concrete with a high specific heat. Also, as the supply air travels radially from the supply air duct, the air expands and loses much of its velocity. Additional velocity is lost when less remote registers release air before that air can reach more distant registers. Thus, remote registers receiving lower pressure air tend to release disproportionately less air to the comfort zone than registers that are closer to the supply air duct.

To avoid these problems, some under-floor HVAC systems include a relatively rigid sheet metal air duct or a pliable tubular air duct that is installed under-floor in the plenum between the subfloor and the floor panels. Under-floor air ducts help channel supply air along a more directed route from the supply air duct to certain remote registers. A drawback of such installations, however, is that under-floor air ducts, particularly pliable ones, tend to retract and extend longitudinally in response to changes in duct pressure. The resulting sliding movement can create noise and abrade the duct material. Moreover, there are endless possible floor layouts with various supply airflow needs, thus it can be difficult and expensive to custom build numerous air duct systems to meet all those needs.

DETAILED DESCRIPTION

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

Figure 1:
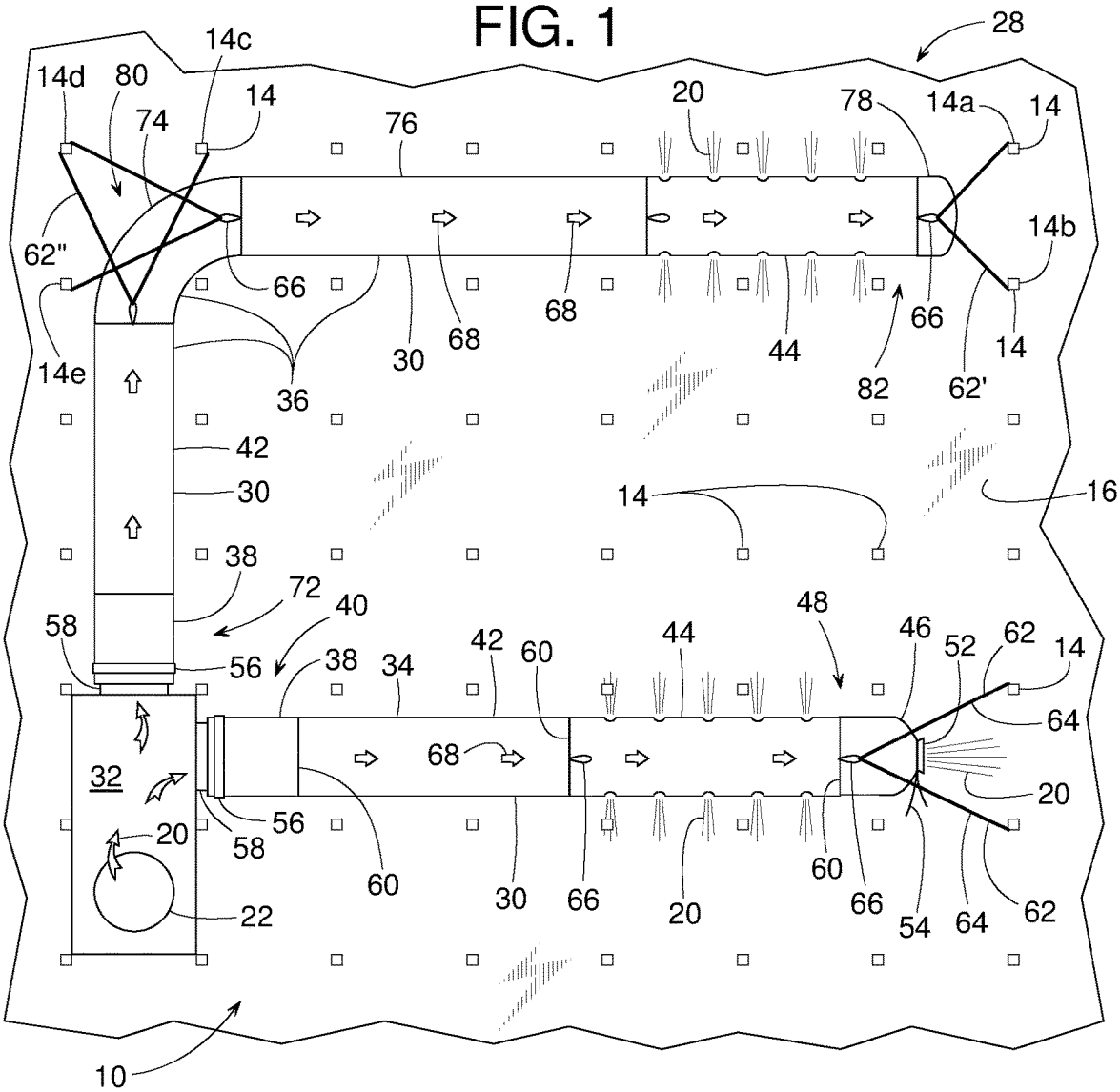
FIG. 1 is a top view of an example of an under-floor air duct system with a plurality of floor panels omitted to show underlying features of the system.
Figure 2:
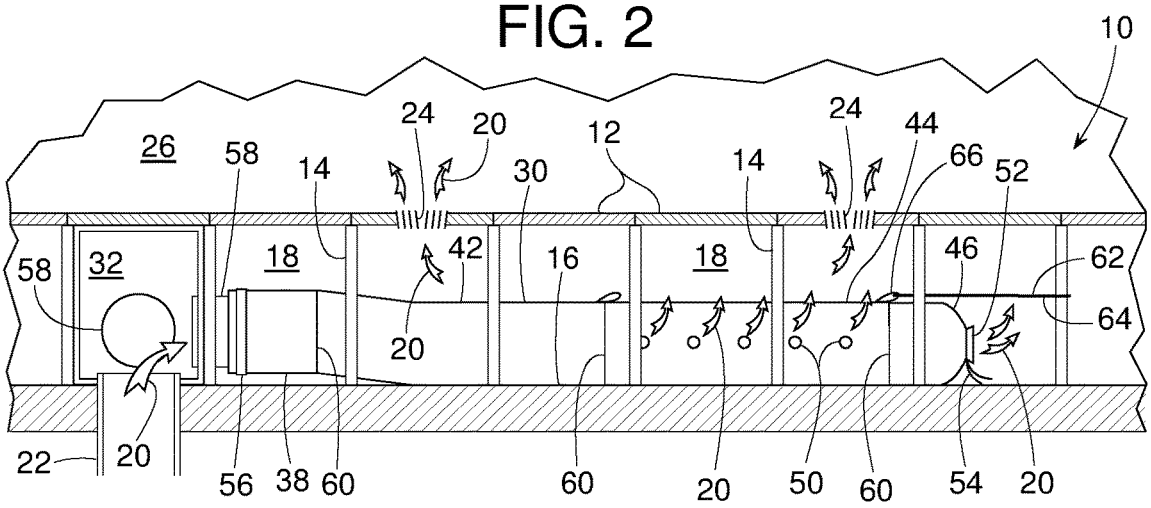
FIG. 2 is a cross sectional view taken along line 2-2 of FIG. 3.
Figure 3:
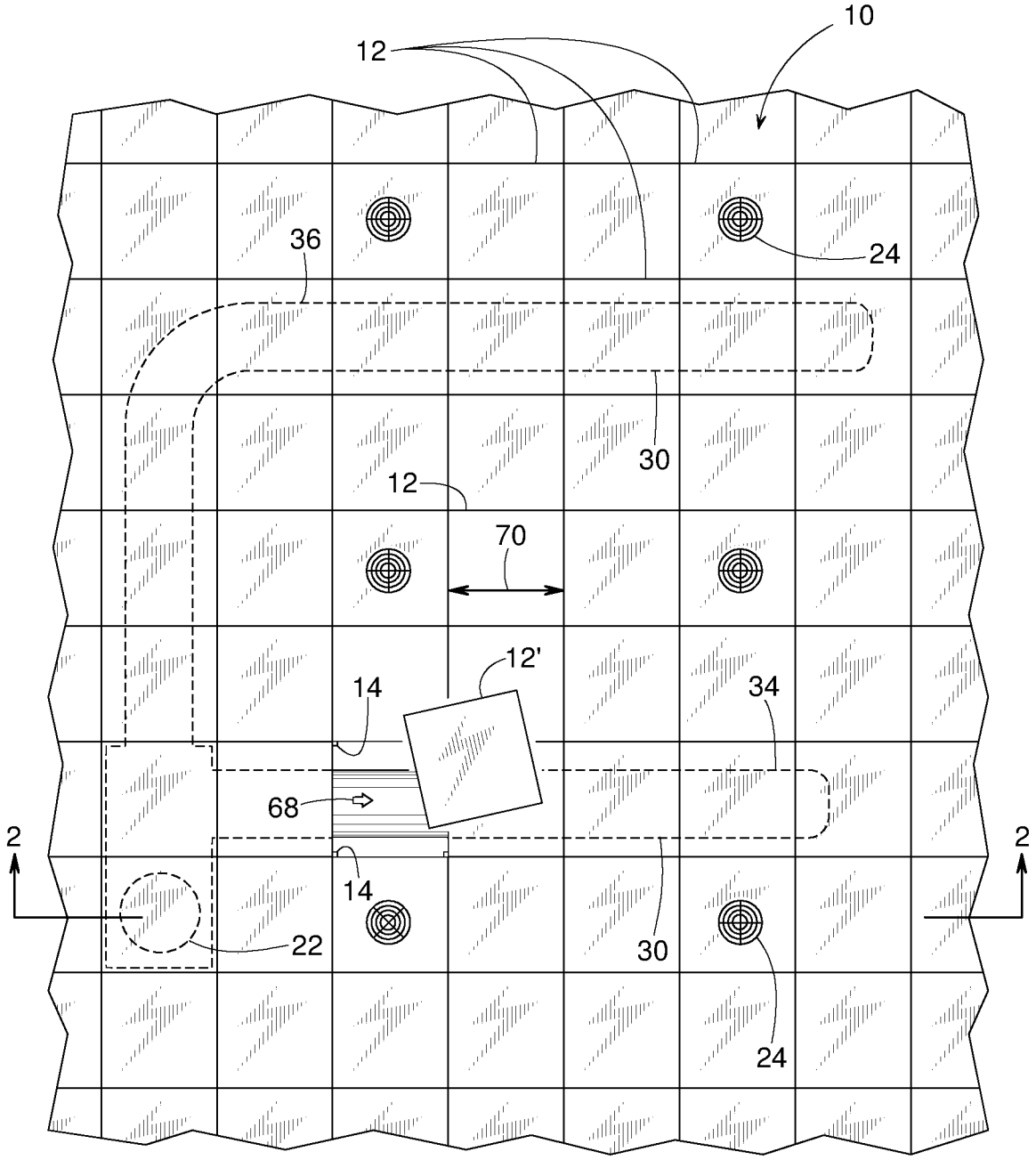
FIG. 3 is a top view similar to FIG. 1 but with most of the floor panels installed.

A building floor 10, shown in FIGS. 1-3, includes a plurality of generally rigid floor panels 12 supported by a matrix of pedestals 14 that extend upward from a subfloor 16. The space between subfloor 16 and floor panels 12 provides a plenum 18 for conveying fresh supply air 20 from a supply air duct 22 to a series of supply air registers 24 in floor panels 12. Supply air 20 discharging upward through air registers 24 helps condition or ventilate a comfort zone 26 that is just above floor panels 12. Comfort zone 26 may be any designated zone supplied with air from a HVAC system, and that may be occupied by people.

To create an air duct system 28 that ensures supply air 20 is evenly distributed or properly apportioned across comfort zone 26, a distribution air duct 30 is installed within plenum 18. Distribution air duct 30 receives supply air 20 from a supply air chamber 32 fed by supply air duct 22 and conveys supply air 20 to wherever it is needed. Distribution air duct 30 is particularly useful for conveying supply air 20 to remote areas of comfort zone 26 that are quite distant from supply air chamber 32.

For sake of example, distribution air duct 30 is shown to include two runs, a straight run 34 and a longer L-shaped run 36; however, any number of runs, shapes or branches of runs are well within the scope of the methods and apparatus described herein. Although the actual construction, assembly and installation of distribution air duct 30 may vary, example runs 34 and 36 are tubes of pliable material, thus distribution air duct 30 generally inflates when pressurized by supply air 20 and tends to collapse (i.e., sag or deflate) when supply air 20 is turned off. The pliable material of distribution air duct 30 can be cloth fabric, sheets of plastic or rubber, porous, nonporous, perforated, nonperforated, and various combinations thereof.

Run 34 of distribution air duct 30 comprises a pliable tubular inlet collar 38 at a proximal end 40 of run 34, a first duct segment 42 that can be porous or nonporous, a second duct segment 44 that is preferably perforated although not necessarily so, and an end cap 46 at a distal end 48 of run 34. To release more supply air 20 near distal end 48, second duct segment 44 includes a series of discharge air perforations 50. First and second duct segments 42 and 44 are examples of an upstream tubular wall section and a downstream tubular wall section, respectively, with first duct segment 42 being more or less air permeable than second duct segment 44. Alternatively, or to release even more supply air 20 near distal end 48, end cap 46 can be provided with a discharge opening 52. The amount of supply air 20 discharged through end cap 46 can be adjusted by tightening or loosening a drawstring 54 at the throat of discharge opening 52. An example of end cap 46 can be found in U.S. Pat. No. 6,558,250.

To assemble run 34, a strap clamp 56 fastens inlet collar 38 to a rigid tubular flange 58 that conveys supply air 20 from supply air chamber 32 to the interior of run 34. To balance or apportion the airflow between runs 34 and 36, a conventional baffle (not shown) can be installed within tubular flange 58. Inlet collar 38, first and second duct segments 42 and 44, and end cap 46 can be joined end-to-end via any suitable fastener 60 including, but not limited to, a zipper running circumferentially around the adjoining pieces. Once assembled, run 34 of distribution air duct 30 can simply rest upon subfloor 16 for vertical support.

For horizontal support, however, or to prevent run 34 from sliding around or repeatedly extending and retracting due to changes in air duct pressure, a fastener 62 preferably connects distal end 48 to one or more pedestals 14. In some examples, fastener 62 comprises an elongate pliable member 64 (e.g., cable, strap, chain, rope, cord, wire, etc.) that connects a loop 66 (e.g., hook, snap connector, etc.) that is sewn or otherwise attached to one end of second duct segment 44. To provide run 34 with horizontal support in two dimensions, elongate pliable member 64 can be attached to two or more pedestals 14 in a generally V-shaped layout as shown in FIG. 1. In the V-shaped layout, fastener 62 can be two individual elongate members or a single elongate member with two legs.

To aid service personnel in maintaining or troubleshooting air duct system 28, distribution air duct 30 preferably includes a series of decals 68 (e.g., label, tag, visual marker, sign, arrowhead, etc.) that are distributed along the upper surface of distribution air duct 30. Decals 68 are best placed at intervals that correspond to the standard dimension of floor panels 12 so that whenever any floor panel 12 above distribution air duct 30 is lifted for service reasons, such as panel 12' of FIG. 3, at least one decal 68 is visible. Two feet is a common standard width 70 for floor panels 12, thus the separation between decals 68 is preferably at most two-foot.

Run 36 is similar in construction to run 34. Run 36 comprises inlet collar 38 at a proximal end 72 of run 36, first duct segment 42, a right-hand tubular elbow 74 made of a pliable material, a relatively long duct segment 76 that can be porous or nonporous, second duct segment 44, and a closed end cap 78. Similar to run 34, strap clamp 56 fastens inlet collar 38 to tubular flange 58, and the various pliable duct segments 42, 44 and 76, inlet collar 38 and elbow 74 can be joined end-to-end by way of zippers.

Run 36 includes a first distal end 80 at elbow 74 and a second distal end 82 at end cap 78. Fastener 62' and loop 66 anchors second distal end 82 to pedestals 14*a* and 14*b*, and fastener 62" anchors elbow 74 to pedestals 14*c*, 14*d* and 14*e*. Fasteners 62' and 62" each can be made of a single elongate member with multiple legs or multiple individual elongate members.

Figure 4:
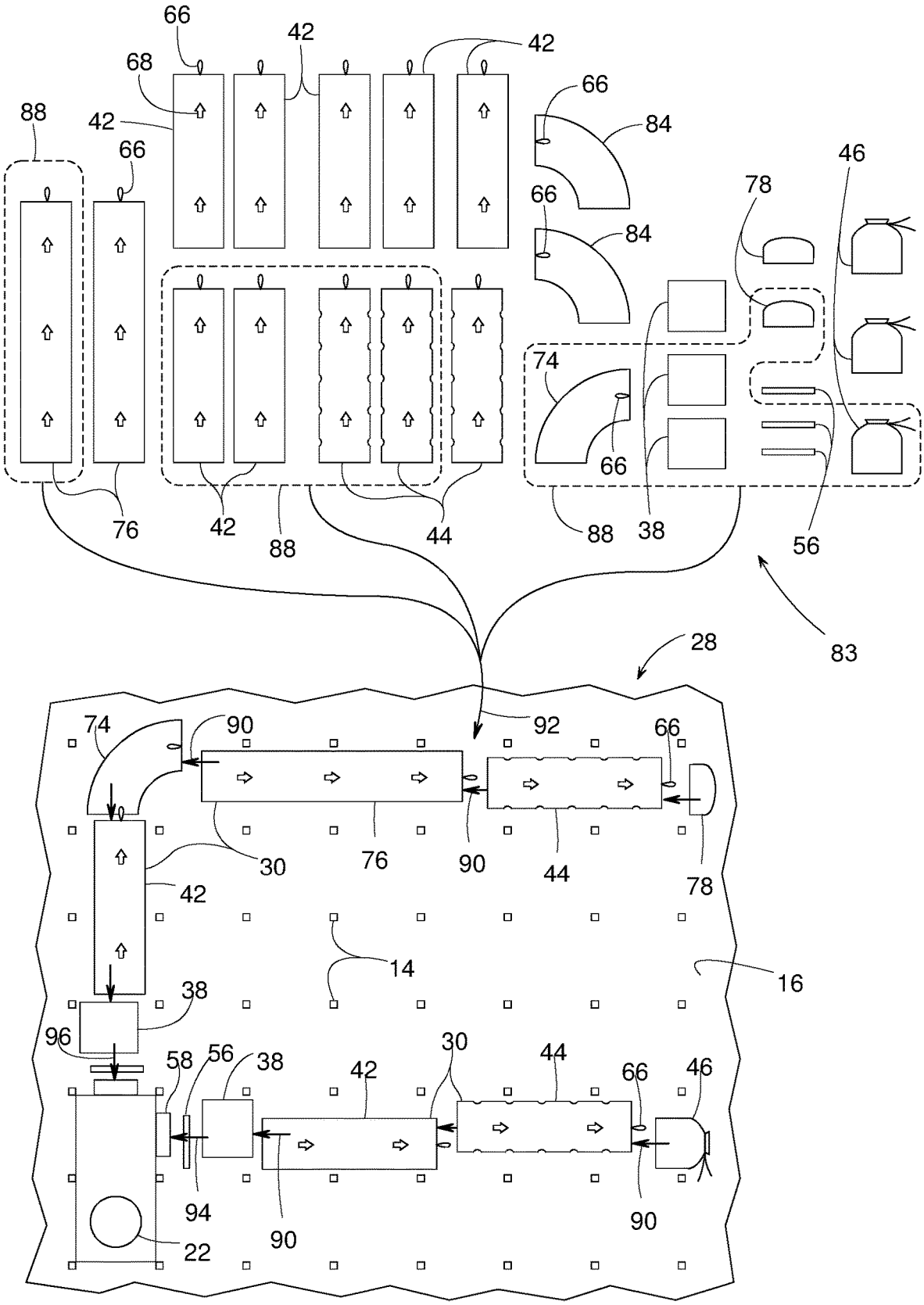
FIG. 4 is an exploded top view illustrating an example of an under-floor method.

Since there are endless possible floor layouts with various supply airflow needs, it can be difficult and expensive to custom build numerous air duct systems to meet all those needs. To address this problem, air duct system 28 preferably is assembled from a predefined assortment of duct segments 83, as shown in FIG. 4. For sake of example, assortment 83 includes two predefined long duct segments 76, seven predefined short first duct segments 42, three predefined second duct segments 44, one right-hand elbow 74, two left-hand elbows 84, three inlet collars 38, two closed end caps 78, three strap clamps 56, and three open end caps 46. The terms "long" and "short" as they relate to duct segments 42 and 76, simply means that one segment of predefined length is longer than the other. It should be noted that right-hand elbow 74 and left-hand elbow 84 are unique and distinguishable from each other by virtue of the location of loop 66 and/or the orientation of their zippered joints.

To create the two-run distribution air duct 30 after defining assortment 83, one strategically chooses a collection 88 of duct segments from assortment 83, wherein collection 88 is depicted by the parts encircled by the dashed lines in FIG. 4. Arrows 90 represents the assembling of collection 88 to create distribution air duct 30, and arrow 92 represents installing of distribution air duct 30. The assembling (arrow 90) of collection 88 and the installing (arrow 92) of air duct 30 do not have to be performed in any particular order. The assembling (arrow 90) of collection 88 and the installing (arrow 92) of air duct 30 can be done in any sequential order or done generally simultaneously. Arrows 94 and 96 each represent coupling proximal ends 40 and 72 to supply air duct 22 such that supply air 20 from supply air duct 22 can pass in series through, for example, proximal end 40, toward distal end 48, out from within distribution air duct 30, into plenum 18, up through supply air register 24 and into comfort zone 26 Once distribution air duct 30 is assembled, fasteners 62 being shown taut in FIGS. 1 and 2 illustrate pulling distribution air duct 30 in tension generally between supply air duct 22 and at least one pedestal 14.

The just-described modular method of assembling a distribution air duct is best achieved when duct segments 42, 44 and 76 are of predefined lengths that are substantially whole number multiples of standard width 70. If, for instance, standard width 70 is two feet, predefined short first duct segment 42 can be two, four, six, eight, . . . 2n feet long. The same is true for predefined long duct segment 76 but with long duct segment 76 being longer than short first duct segment 42.

At least some of the aforementioned examples include one or more features and/or benefits including, but not limited to, the following:

In some examples, an air duct system for a building comprises a collection of pliable tubular segments that are assembled end-to-end to create a distribution air duct that rests upon a subfloor below a plurality of removable floor panels. To help keep the distribution air duct from sliding freely along the subfloor, the air duct is held taut by anchoring a distal downstream end of the duct to at least one and preferable two or three pedestals that help support the floor panels above the subfloor.

In some examples, a distribution air duct is assembled from a collection of pliable tubular segments chosen from a predefined assortment of segments, wherein the assortment of segments are of discrete lengths based upon the width of a standard floor panel.

In some examples, a distribution air duct made of one or more pliable tubes rests directly upon a subfloor, thereby eliminating the need for any overhead mounting support, such as an overhead cable or track.

In some examples, a pliable distribution air duct includes a series of flow direction indicators that are distributed along the length of the duct at a spacing interval that corresponds to the width of a standard floor panel.

In some examples, an under-floor distribution air duct includes an end cap with an adjustable discharge opening.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

What is claimed is:

1. An air duct system comprising:

a duct segment disposable within a plenum underneath a floor of a building, the duct segment including a pliable tubular wall extending from a first end of the duct segment to a second end of the duct segment, the first end to be coupled to a supply air duct within the plenum; and a fastener to enable connection of a connection point on an exterior surface of the duct segment adjacent the second end to a portion of the building, the fastener to pull the duct segment, via the connection point at the second end of the duct segment, in a direction opposite the first end of the duct segment thereby placing the duct segment in tension along a length of the duct segment between the first and second ends, the fastener being a single elongate pliable member that includes a first leg and a second leg, both the first and second legs to be angled relative to the length of the duct segment to provide horizontal support to the duct segment in two dimensions.

2. The air duct system of claim 1, wherein the duct segment includes no vertical support mechanism along the length of the duct segment between the first end of the duct segment and the connection point at the second end of the duct segment.

3. The air duct system of claim 1, wherein vertical support for the duct segment is to be provided by a subfloor upon which the duct segment is to rest and without a support system connected to an upper portion of the duct segment between the first end of the duct segment and the connection point at the second end of the duct segment.

4. The air duct system of claim 1, wherein the first and second legs are to form a V-shape with a vertex located adjacent the connection point.

5. The air duct system of claim 4, wherein the first leg of the fastener is to pull the duct segment by a first force having a first component parallel to a central longitudinal axis of the duct segment and a second component perpendicular to the central longitudinal axis, the second leg of the fastener is to pull the duct segment by a second force having a third component parallel to the central longitudinal axis and a fourth component perpendicular to the central longitudinal axis, the second component of the first force and the fourth component of the second force to extend in opposite directions to provide the horizontal support securing the duct segment in the two dimensions.

6. The air duct system of claim 4, wherein the first leg of the fastener is a first elongate pliable member and the second leg of the fastener is a second elongate pliable member, the first elongate pliable member being separate from the second elongate pliable member.

7. The air duct system of claim 1, wherein a first distal end of the first leg of the fastener is to extend beyond the second end of the duct segment at a first angle relative to a central longitudinal axis of the duct segment such that the first distal end is located farther from the central longitudinal axis in a first lateral direction than an outer surface of the duct segment is laterally spaced from the central longitudinal axis, a second distal end of the second leg of the fastener to extend beyond the second end of the duct segment at a second angle relative to the central longitudinal axis of the duct segment such that the second distal end is located farther from the central longitudinal axis in a second lateral direction than the outer surface of the duct segment is laterally spaced from the central longitudinal axis, the first lateral direction extending in an opposite direction from the second lateral direction.

8. The air duct system of claim 1, wherein the duct segment is a first duct segment, the air duct system further including a second duct segment to be coupled to the first duct segment.

9. The air duct system of claim 8, wherein the first duct segment extends along a straight longitudinal direction and the second duct segment extends along the straight longitudinal direction, the second duct segment to be positioned between the supply air duct and first duct segment, the fastener to place the second duct segment in tension based on the fastener pulling on the first duct segment.

10. The air duct system of claim 8, further including an elbow to be positioned between the first duct segment and the second duct segment, the first duct segment to extend along a first longitudinal direction and the second duct segment to extend along a second longitudinal direction, the first longitudinal direction being substantially perpendicular to the second longitudinal direction.

11. The air duct system of claim 8, wherein the first duct segment is more air permeable than the second duct segment.

12. An air duct system comprising:

a first duct segment disposable within a plenum underneath a floor of a building, the first duct segment including a pliable tubular wall extending from a first end of the first duct segment to a second end of the first duct segment, the first end to be coupled to a supply air duct within the plenum;

a second duct segment to be coupled to the first duct segment, the second duct segment including first and second ends;

an elbow to be positioned between the first duct segment and the second duct segment, the elbow including first and second ends, the first end of the elbow to be connected to the second end of the second duct segment, the second end of the elbow to be connected to the first end of the first duct segment, the first duct segment to extend along a first longitudinal direction and the second duct segment to extend along a second longitudinal direction, the first longitudinal direction being substantially perpendicular to the second longitudinal direction; and a fastener to enable connection of a connection point on an exterior surface of the first duct segment adjacent the second end of the first duct segment to a portion of the building, the fastener to pull the first duct segment, via the connection point at the second end of the first duct segment, in a direction opposite the first end of the first duct segment thereby placing the first duct segment in tension along a length of the first duct segment between the first and second ends of the first duct segment, the fastener to extend beyond the second end of the second duct segment in the second longitudinal direction a first distance, the first distance greater than a second distance, the second distance extending in the second longitudinal direction from the second end of the second duct segment to a line parallel the first longitudinal direction along a surface of the first duct segment farthest away from the second duct segment.

13. An air duct system comprising:

a first duct segment disposable within a plenum underneath a floor of a building, the first duct segment including a pliable tubular wall extending from a first end of the first duct segment to a second end of the first duct segment, the first end to be coupled to a supply air duct within the plenum;

a second duct segment to be coupled to the first duct segment an elbow to be positioned between the first duct segment and the second duct segment, the first duct segment to extend along a first longitudinal direction and the second duct segment to extend along a second longitudinal direction, the first longitudinal direction being substantially perpendicular to the second longitudinal direction;

a fastener to enable connection of a first connection point on an exterior surface of the first duct segment adjacent the second end to a first portion of the building, the fastener to pull the first duct segment, via the first connection point at the second end of the first duct segment, in a direction opposite the first end of the first duct segment thereby placing the first duct segment in tension along a length of the first duct segment between the first and second ends;

a second fastener to enable connection of a second connection point to a second portion of the building, the second connection point attached to one of the elbow or the second duct segment adjacent a first interface between the elbow and the second duct segment; and a third fastener to enable connection of a third connection point to a third portion of the building, the third connection point attached to one of the elbow or the first duct segment adjacent a second interface between the elbow and the first duct segment, the second fastener to pull the second duct segment in the second longitudinal direction toward the elbow, the third fastener to pull the first duct segment in the first longitudinal direction toward the elbow.

14. The air duct system of claim 13, wherein the second fastener is to form a first V-shape and the third fastener is to form a second V-shape, the first V-shape to open away from the second duct segment and the second V-shape to open away from the first duct segment, the first V-shape to be rotated relative to the second V-shape.

15. An air duct system comprising:

a duct segment disposable within a plenum underneath a floor of a building between first and second substantially parallel lines of pedestals supporting the floor, the duct segment including;

a first pliable tubular wall extending from a first end of the duct segment to a second end of the duct segment; and a connection point on the first pliable tubular wall at the first end of the duct segment, the connection point to be proximate a location on a circumference of the first end of the duct segment that is opposite a contact point on the circumference of the first end of the duct segment, the contact point to face a subfloor underneath the floor when the duct segment is disposed within the plenum;

an elbow to be attached to the first end of the duct segment to direct airflow through the air duct system between first and second pedestals in the first line of the pedestals; and a fastener to enable connection of the connection point to at least one of the first or second pedestals, the fastener to pull the duct segment, via the connection point at the first end of the duct segment, toward the elbow to provide horizontal support to the duct segment.

* * * * *